US011859887B2

(12) United States Patent
Zhou et al.

(10) Patent No.: US 11,859,887 B2
(45) Date of Patent: Jan. 2, 2024

(54) ICE MAKING ASSEMBLY AND REFRIGERATOR APPLIANCE

(71) Applicants: Haier US Appliance Solutions, Inc., Wilmington, DE (US); Qianmao Zhou, Shanghai (CN)

(72) Inventors: Qianmao Zhou, Shanghai (CN); Yayu Song, Shanghai (CN); Bo Yan, Shanghai (CN); Jianwu Li, Louisville, KY (US); Xiaoyang Jiang, Shanghai (CN); Lixin Zhou, Shanghai (CN); Jun Teng, Shanghai (CN); Zhongyang Sun, Shanghai (CN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/866,629

(22) PCT Filed: Mar. 5, 2020

(86) PCT No.: PCT/CN2020/078015

§ 371 (c)(1),
(2) Date: May 5, 2020

(87) PCT Pub. No.: WO2021/174491

PCT Pub. Date: Sep. 10, 2021

(65) Prior Publication Data

US 2023/0112446 A1 Apr. 13, 2023

(51) Int. Cl.
*F25C 5/04* (2006.01)
*F25C 1/24* (2018.01)

(52) U.S. Cl.
CPC ..... *F25C 5/04* (2013.01); *F25C 1/24* (2013.01); *F25C 2400/10* (2013.01)

(58) Field of Classification Search
CPC ..... F25C 1/24; F25C 1/246; F25C 2400/10; F25C 5/04; F25C 5/182
See application file for complete search history.

(56) References Cited

U.S. PATENT DOCUMENTS 5,992,167 A 11/1999 Hill et al.
6,112,540 A * 9/2000 Serrels ..... F25C 1/04 62/353

(Continued)

FOREIGN PATENT DOCUMENTS

CN 101008540 A 8/2007
CN 101074822 A 11/2007

(Continued)

*Primary Examiner* — Elizabeth J Martin
(74) *Attorney, Agent, or Firm* — Dority & Manning, P.A.

(57) ABSTRACT

A refrigerator appliance or ice making assembly, as provided herein, may include a body and an ejector. The body may include an ice mold for receiving and freezing water. The ice mold may define a discrete first compartment and second compartment within which water freezes. The first compartment may define a first cube profile. The second compartment may be axially-spaced apart from the first compartment and define a second cube profile. The second cube profile may be different from the first cube profile. The ejector may be rotatably disposed above the first cube profile and the second cube profile to motivate ice from the first and second compartments.

20 Claims, 12 Drawing Sheets

(56) References Cited

U.S. PATENT DOCUMENTS

| | | | | |
|---|---|---|---|---|
| 2007/0170345 | A1* | 7/2007 | Tsujimoto | F25C 5/08 249/105 |
| 2016/0216020 | A1 | 7/2016 | Harold | |
| 2019/0024962 | A1* | 1/2019 | Lee | F25D 23/025 |

FOREIGN PATENT DOCUMENTS

| | | | |
|---|---|---|---|
| CN | 202254599 | U | 5/2012 |
| CN | 102778096 | A | 11/2012 |
| CN | 109307392 | A | 2/2019 |
| JP | 2001194037 | A | 7/2001 |
| JP | 2005351624 | A | 12/2005 |
| JP | 3781767 | B2 | 5/2006 |
| KR | 100531289 | B1 | 11/2005 |
| KR | 101200418 | B1 | 11/2012 |

* cited by examiner

ICE MAKING ASSEMBLY AND REFRIGERATOR APPLIANCE

CROSS-REFERENCE TO RELATED APPLICATIONS

The present application is the National Stage Entry of and claims the benefit of priority under 35 U.S.C. § 371 to PCT Application Serial No. PCT/CN2020/078015 filed Mar. 5, 2020 and entitled ICE MAKING ASSEMBLY AND REFRIGERATOR APPLIANCE, which is hereby incorporated by reference in its entirety.

FIELD OF THE INVENTION

The present subject matter relates generally to ice making assemblies, and more particularly to an ice making assembly for a refrigerator appliance.

BACKGROUND OF THE INVENTION

Certain refrigerator appliances include an ice maker for producing ice. The ice maker can receive liquid water, and such liquid water can freeze within the ice maker to form ice. In particular, certain ice makers include a mold body that defines a plurality of cavities. The plurality of cavities can be filled with liquid water, and such liquid water can freeze within the plurality of cavities to form ice cubes.

Many refrigerator appliances mount ice making assemblies within a cabinet or rotating door. For instance, in a "bottom freezer" type refrigerator where the freezer chamber is arranged below or beneath a top mounted fresh food chamber, an automatic ice maker is often disposed in a thermally insulated ice compartment mounted or formed on a door for the top mounted fresh food chamber. During use, ice is delivered through an opening on the door for the fresh food chamber. As another example, a "side by side" type refrigerator, where the freezer chamber is arranged next to the fresh food chamber, an automatic ice maker is often disposed on the door for either one of the freezer chamber or the fresh food chamber. During use, ice is delivered through an opening formed on the door of the respective compartment.

Generally, ice makers are configured to produce ice cubes of a single shape and size. This may be due, for example, the size and space constraints on most appliances. Specifically, it would generally be very difficult arrange or assemble a refrigerator appliance with multiple ice makers to produce different types of ice. Nonetheless, situations where arise wherein different shape or size of ice cube is preferable. For instance, in some situations, a user may wish for ice cubes to melt relatively slowly, such as to prevent watering down certain beverages. In such instances, a relatively large ice cube shape and size may be preferable. In other situations, a user may wish to rapidly cool a beverage, such as providing a high surface area of ice. In such instances, a relatively small cube shape and size may be preferable. Moreover, regardless of the intended use case, users may generally prefer different ice shapes or sizes on different occasions (e.g., based on what container the ice is going into or based on a preferred mouth feel for users).

Accordingly, it would be advantageous to provide an automatic ice maker that addresses one or more of these challenges. In particular, it would be useful to provide a single ice maker capable of producing ice cubes of differing shapes or sizes (e.g., without generally increasing the overall size or complexity of the ice maker).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice making assembly is provided. The ice making assembly may include a body and an ejector. The body may include an ice mold for receiving and freezing water. The ice mold may define a discrete first compartment and second compartment within which water freezes. The first compartment may define a first cube profile. The second compartment may be axially-spaced apart from the first compartment and define a second cube profile. The second cube profile may be different from the first cube profile. The ejector may be rotatably disposed above the first cube profile and the second cube profile to motivate ice from the first and second compartments.

In another exemplary aspect of the present disclosure, a refrigerator appliance is provided. The refrigerator appliance may include a cabinet, a door, and an ice maker. The cabinet may define a chilled chamber. The door may be mounted to the cabinet. The ice maker may be mounted to the door. The ice maker may include a body and an ejector. The body may include an ice mold for receiving and freezing water. The ice mold may define a discrete first compartment and second compartment within which water freezes. The first compartment may define a first cube profile. The second compartment may be axially-spaced apart from the first compartment and define a second cube profile. The second cube profile may be different from the first cube profile. The ejector may be rotatably disposed above the first cube profile and the second cube profile to motivate ice from the first and second compartments.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
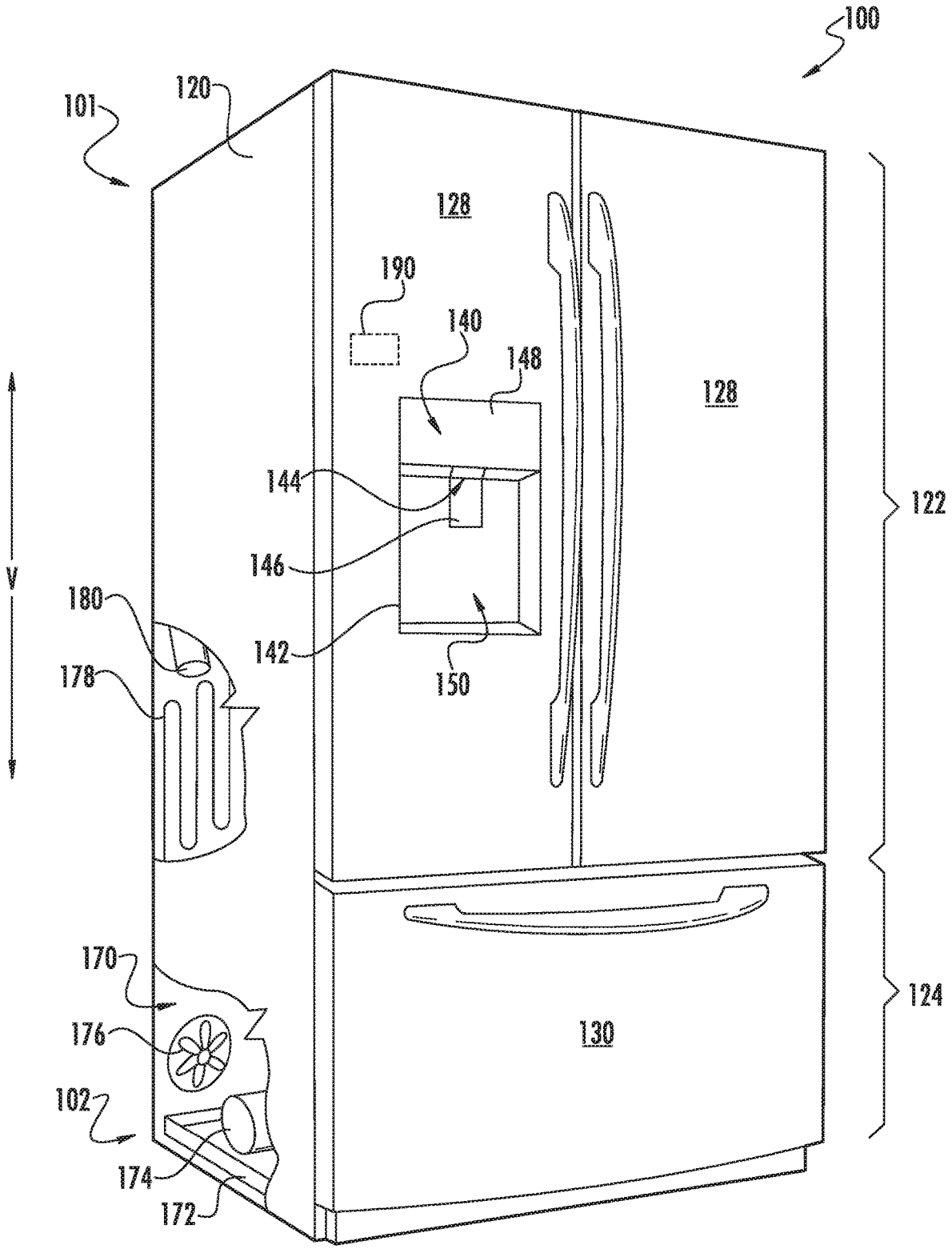
FIG. 1 provides a perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The term "or" is generally intended to be inclusive (i.e., "A or B" is intended to mean "A or B or both," except as otherwise indicated).

Turning now to the figures, FIG. 1 provides a perspective view of a refrigerator appliance 100 according to exemplary embodiments of the present disclosure. Refrigerator appliance 100 includes a cabinet or housing 120 that extends between a top portion 101 and a bottom portion 102 along a vertical direction V. Housing 120 defines one or more chilled chambers for receipt of food items for storage. In particular, housing 120 defines fresh food chamber 122 positioned at or adjacent top portion 101 of housing 120 and a freezer chamber 124 arranged at or adjacent bottom portion 102 of housing 120. As such, refrigerator appliance 100 is generally referred to as a bottom mount refrigerator. It is recognized, however, that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular chilled chamber configuration.

In some embodiments, refrigerator doors 128 are rotatably hinged to an edge of housing 120 for selectively accessing fresh food chamber 122. A freezer door 130 is arranged below refrigerator doors 128 for selectively accessing freezer chamber 124. Freezer door 130 may be coupled to a freezer drawer (not shown) slidably mounted within freezer chamber 124. Refrigerator doors 128 and freezer door 130 are shown in a closed configuration in FIG. 1.

Refrigerator appliance 100 also includes a dispensing assembly 140 for dispensing liquid water or ice. Dispensing assembly 140 includes a dispenser 142 positioned on or mounted to an exterior portion of refrigerator appliance 100 (e.g., on one of doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (e.g., an ultrasonic sensor) or a button rather than the paddle. In some embodiments, a user interface panel 148 is provided for controlling the mode of operation. For example, user interface panel 148 may include a plurality of user inputs (not labeled), such as a water dispensing button and an ice dispensing button, for selecting a desired mode of operation such as crushed or non-crushed ice.

In the illustrated embodiments, discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Operation of the refrigerator appliance 100 can be regulated by a controller 190 that is operatively coupled to user interface panel 148 or various other components. User interface panel 148 provides selections for user manipulation of the operation of refrigerator appliance 100 such as, for example, selections between whole or crushed ice, chilled water, or other various options. In response to user manipulation of user interface panel 148 or one or more sensor signals, controller 190 may operate various components of the refrigerator appliance 100. Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 190 may be positioned in a variety of locations throughout refrigerator appliance 100. In the illustrated embodiments, controller 190 is located within the user interface panel 148. In other embodiments, the controller 190 may be positioned at any suitable location within refrigerator appliance 100, such as, for example, within a fresh food chamber 122, a freezer door 130, etc. Input/output ("I/O") signals may be routed between controller 190 and various operational components of refrigerator appliance 100. For example, user interface panel 148 may be in communication with controller 190 via one or more signal lines or shared communication busses.

As illustrated, controller 190 may be in communication with the various components of dispensing assembly 140 and may control operation of the various components. For example, the various valves, switches, etc. may be actuatable based on commands from the controller 190. As discussed, interface panel 148 may additionally be in communication with the controller 190. Thus, the various operations may occur based on user input or automatically through controller 190 instruction.

Figure 2:
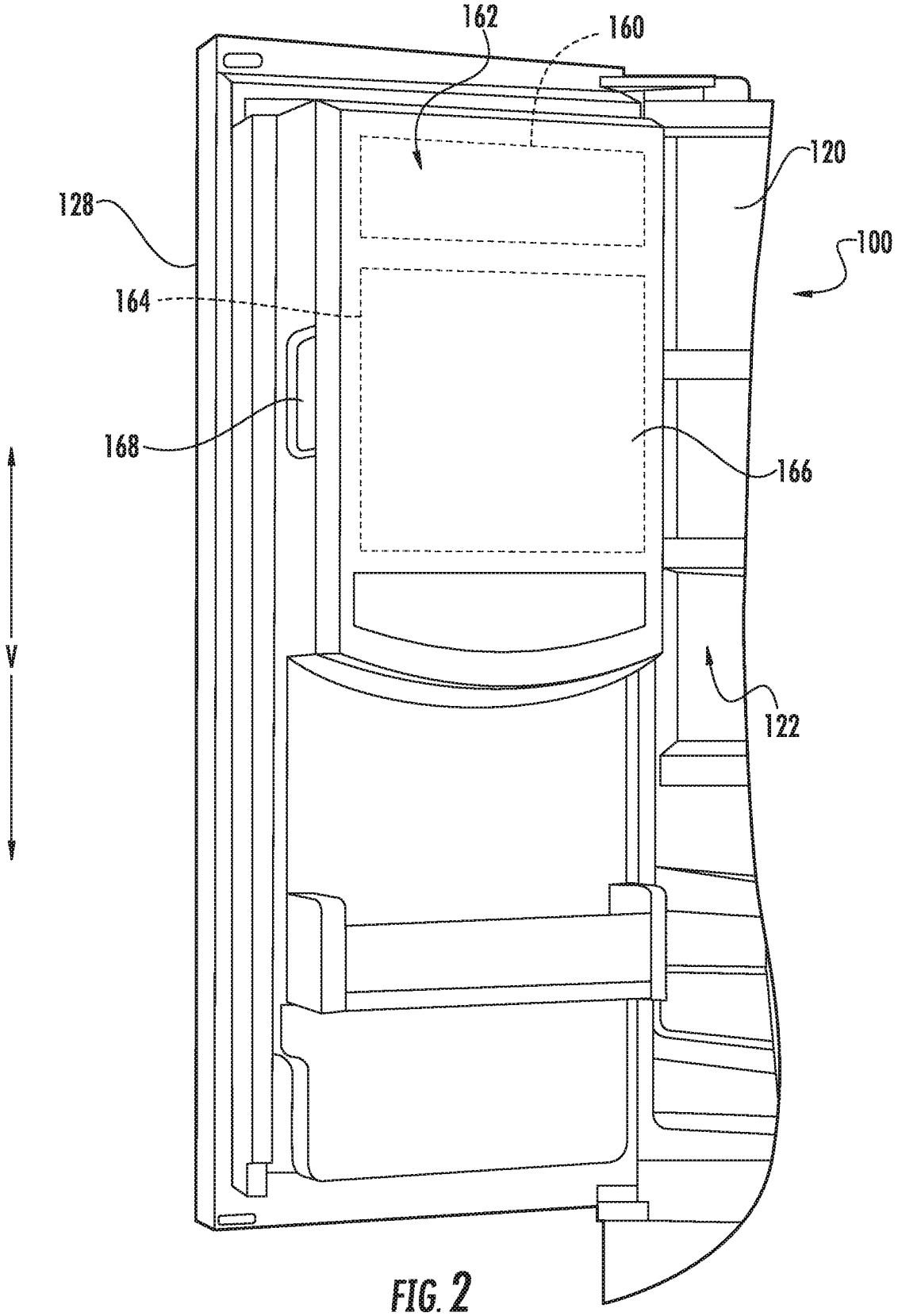
FIG. 2 provides a perspective view of a door of the exemplary refrigerator appliance of FIG. 1.
Figure 3:
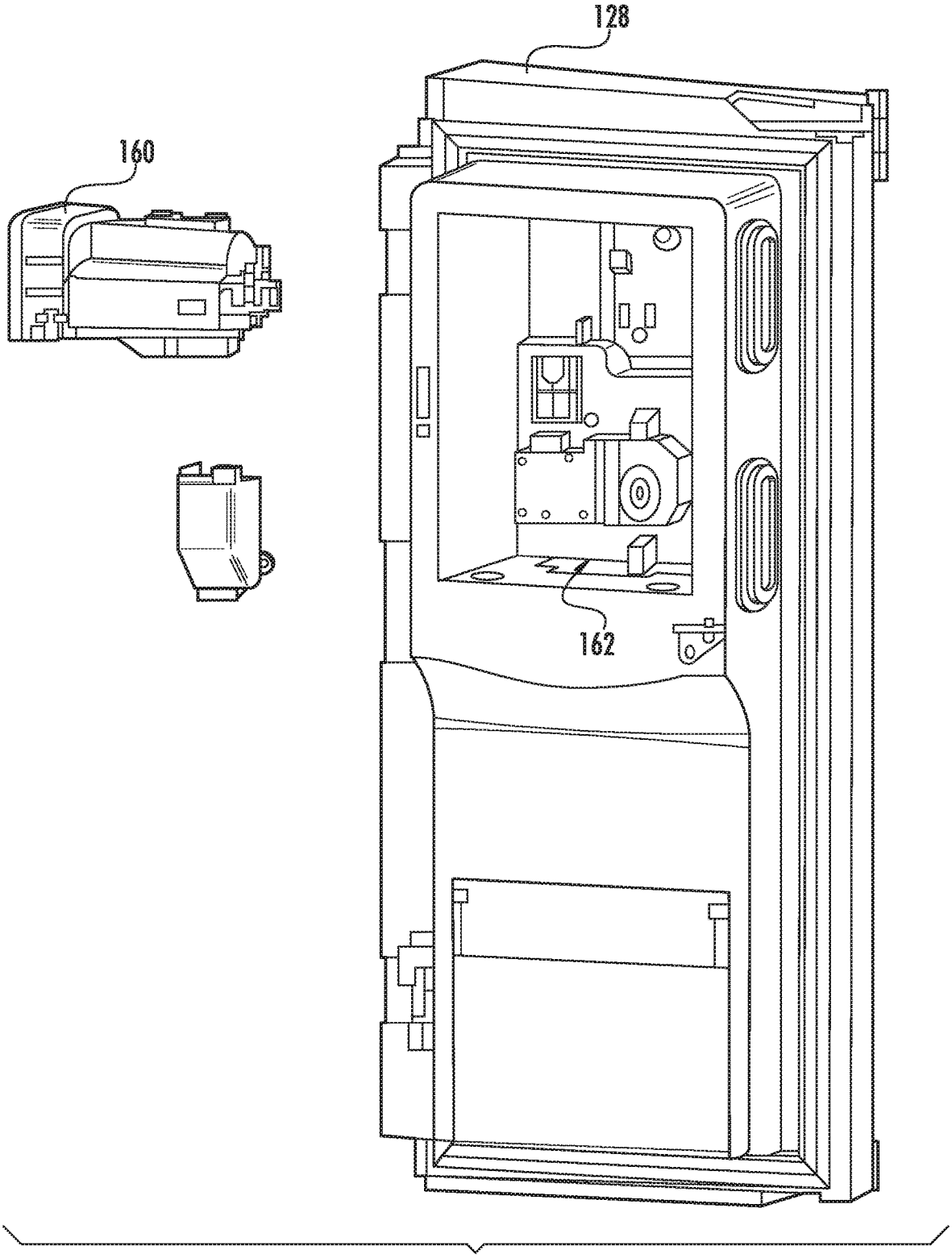
FIG. 3 provides an exploded perspective view of a portion of the exemplary refrigerator door of FIG. 2.
Figure 4:
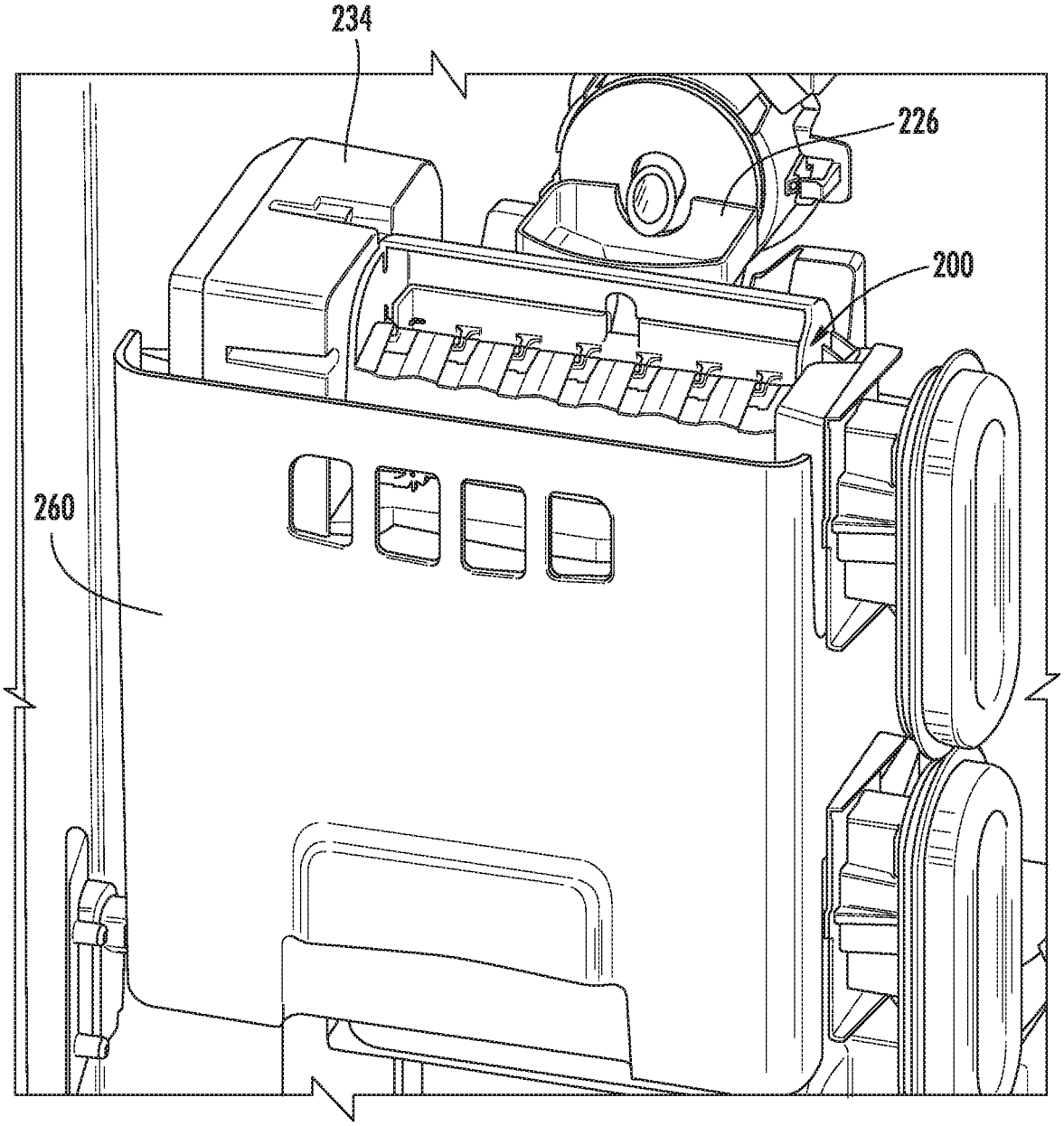
FIG. 4 provides a perspective view of an ice making assembly according to exemplary embodiments of the present disclosure.
Figure 5:
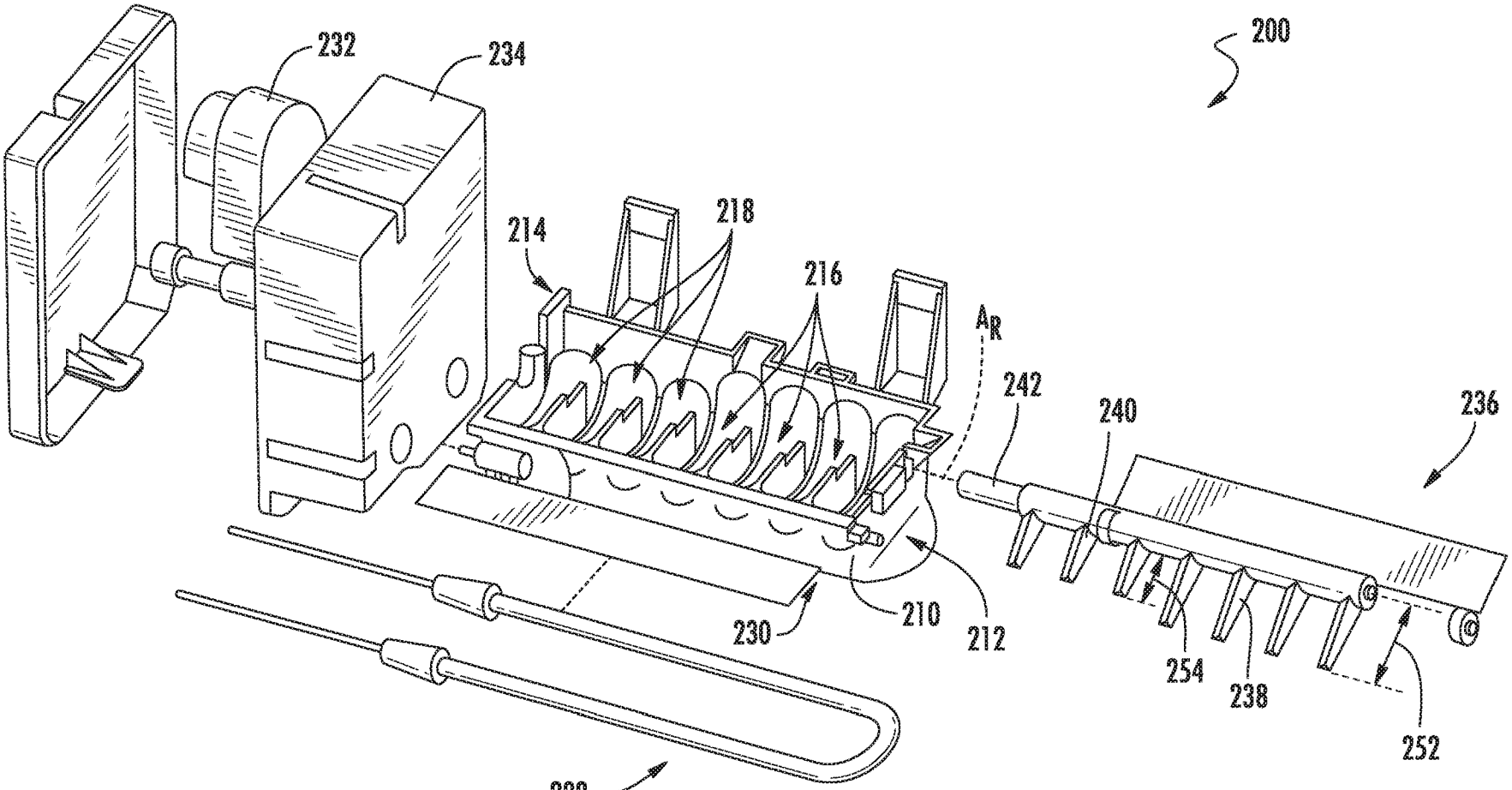
FIG. 5 provides an exploded perspective view of an ice maker of the exemplary ice making assembly of FIG. 4.
Figure 6:
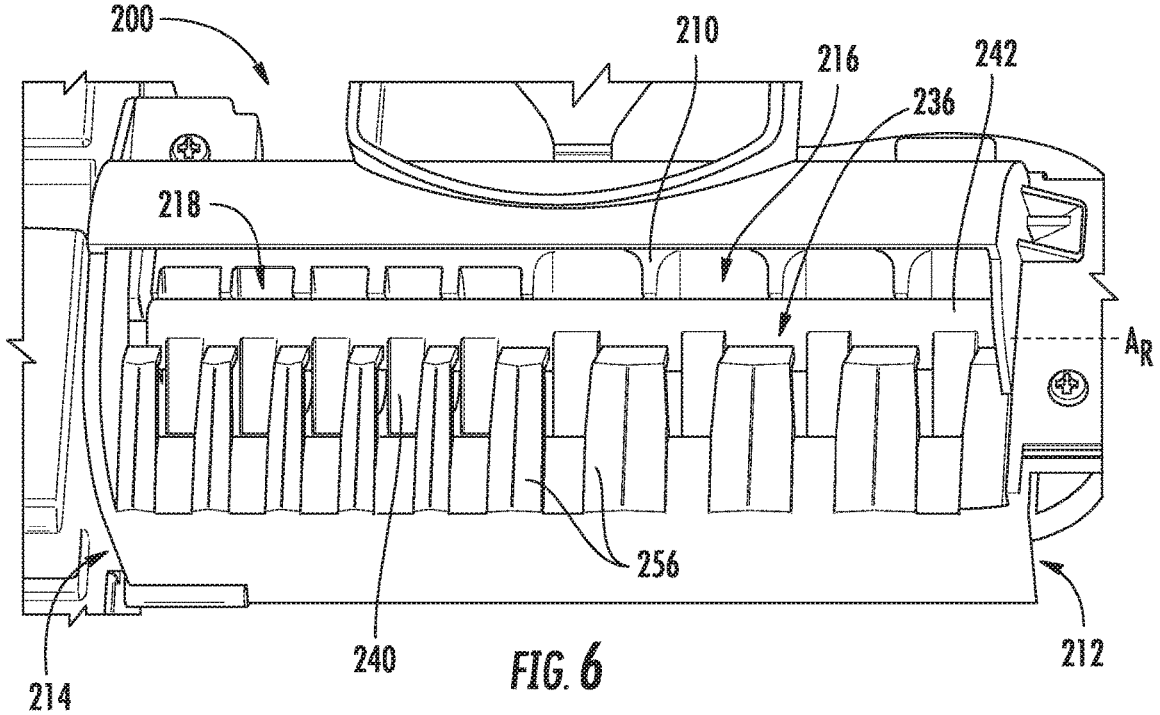
FIG. 6 provides a perspective view of the ice maker of the exemplary ice making assembly of FIG. 5.

FIG. 2 provides a perspective view of a door of refrigerator doors 128. FIG. 3 provides an exploded view of a portion of refrigerator door 128 with an access door 166 removed. Refrigerator appliance 100 includes a sub-compartment 162 defined on refrigerator door 128. Sub-compartment 162 is often referred to as an "icebox." Moreover, sub-compartment 162 extends into fresh food chamber 122 when refrigerator door 128 is in the closed position.

Generally, an ice supply assembly may be provided to supply ice to dispenser recess 150 (FIG. 1) from ice maker 160 or a separate ice bin 164 in sub-compartment 162 on a back side of refrigerator door 128. In optional embodiments, chilled air from a sealed refrigeration system of refrigerator appliance 100 may be directed into ice maker 160 in order to cool components of ice maker 160. For instance, an evaporator 178 (FIG. 1) may be positioned at or within fresh food chamber 122 or freezer chamber 124 and be configured for generating cooled or chilled air. A supply conduit 180 (FIG. 1) may be defined by or positioned within housing 120 and may extend between evaporator 178 and components of ice maker 160 in order to cool components of ice maker 160 and assist ice formation by ice maker 160.

In optional embodiments, liquid water generated during melting of ice cubes in ice storage bin 164, is directed out of the ice storage bin 164. For example, turning back to FIG. 1, liquid water from melted ice cubes may be directed to an evaporation pan 172. Evaporation pan 172 is positioned within a mechanical compartment 170 defined by housing 120 (e.g., at bottom portion 102 of housing 120). A condenser 174 of the sealed system can be positioned, for example, directly-above and adjacent evaporation pan 172. Heat from condenser 174 can assist with evaporation of liquid water in evaporation pan 172. A fan 176 configured for cooling condenser 174 can also direct a flow air across or into evaporation pan 172. Thus, fan 176 can be positioned above and adjacent evaporation pan 172. Evaporation pan 172 is sized and shaped for facilitating evaporation of liquid water therein. For example, evaporation pan 172 may be open topped and extend across about a width or a depth of housing 120.

In optional embodiments, an access door 166 is hinged to refrigerator door 128. Access door 166 may generally permit selective access to sub-compartment 162. Any manner of suitable latch 168 is configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162.

Turning now generally to FIGS. 4 through 10, various views are provided an exemplary ice maker 200, including portions thereof. As is understood, ice maker 200 may be used within any suitable refrigerator appliance, such as refrigerator appliance 100 (FIG. 1).

Generally, ice maker 200 includes an ice mold or mold body 210 that extends between a first end portion 212 and a second end portion 21 (e.g., along a rotation axis $A_R$). Mold body 210 defines multiple compartments (e.g., one or more first compartments 216 and one or more second compartments 218) separated by one or more partitions walls 220 for receipt of liquid water for freezing. The compartments 216, 218 may be spaced apart from one another or distributed (e.g., along the rotation axis $A_R$ between first end portion 212 and second end portion 214). Thus, a partition wall 220 may be axially positioned between a first compartment 216 and a second compartment 218.

As shown, each partition wall 220 generally extends vertically (e.g., to an upper fill line 222). In optional embodiments, a notch gap 224 is defined by a partition wall 220 and extend as a void to a predetermined height (e.g., lowermost extreme) below the fill line. In turn, liquid water above the predetermined height may be exchanged between axially-adjacent compartments 216 or 218.

Generally, ice maker 200 can receive liquid water (e.g., from a water connection to plumbing within a residence or business housing refrigerator appliance 100) and direct such liquid water into mold body 210 (e.g., into compartments 216, 218 of mold body 210). For instance, a water guide 226 may be mounted above mold body 210 to direct water to mold compartments 216, 218.

Within compartments 216, 218 of mold body 210, liquid can freeze to form ice cubes. It is understood that the term "ice cube," as used herein, does not require a cubic geometry (i.e., six bounded square faces), but indicates a discrete unit of solid frozen ice generally having a predetermined three-dimensional shape.

In some embodiments, a sheathed electrical resistance heating element or heater 228 is mounted to a lower portion 230 of mold body 210 (e.g., beneath the first and second compartments 216, 218). The heater 228 can be press-fit, stacked, or clamped into the lower portion 230 of the mold body 210. The heater 228 is configured to heat the mold body 210 when a harvest cycle is executed (e.g., as initiated or directed by controller 190) to slightly melt the ice cubes and release the ice from the compartments 216, 218.

In some embodiments, ice maker 200 includes a motor 232. As shown, motor 232 may be positioned within a motor housing 234. Additionally or alternatively, motor 232 may be in mechanical communication with an ejector 236 (e.g., via one or more gears). When assembled, motor 232 may be mounted to one end portion. For instance, motor 232 and motor housing 234 may be disposed proximal to second compartments 218 at second end portion 214.

As shown, ejector 236 is generally mounted to or above at least a portion of mold body 210. In some embodiments, ejector 236 includes multiple harvesters 238, 240. For instance, a first harvester 238 may correspond to a first compartment 216 while a second harvester 240 corresponds to a second compartment 218. Thus, first harvester 238 may selectively extend within the first compartment 216 from the main shaft 242 and second harvester 240 may selectively extend within the second compartment 218 from the main shaft 242. Optionally, a discrete harvester 238 or 240 may correspond to each compartment 216 or 218. In turn, multiple harvesters 238 or 240 may be spaced apart from each other or distributed along the rotation axis $A_R$. During use, each harvester 238 or 240 may be selectively received within a respective compartment 216 or 218. As an example, motor 232 may rotate ejector 236 about the rotation axis $A_R$. Specifically, a main shaft 242 of ejector 236 can be rotated in either a first rotational direction or a second, opposite rotational direction. The harvesters 238 or 240 may rotate in tandem with main shaft 242 or each other.

In some embodiments, main shaft 242 extends along rotation axis $A_R$. In other embodiments, main shaft 242 extends along a separate axis that is parallel to rotation axis $A_R$ and is offset (e.g., along a radial direction from the rotation axis $A_R$) by any suitable distance. As ejector 236 is rotated by motor 232, harvesters 238 or 240 can move or slide into compartments 216, 218 and push or urge ice cubes out of compartments 216, 218.

Turning especially to FIGS. 6 through 10, various views are provided of ice maker 200 according to exemplary embodiments. As illustrated, in some embodiments, a plurality of discrete compartments 216, 218 may be axially-spaced apart from each other. Additionally or alternatively, two or more of the compartments 216, 218 may be uniquely formed such that the compartments 216, 218 form ice cubes of a different shape. In other words, at least two compartments 216, 218 may define different cube profiles 244, 246, which act as the negative molds of ice cubes formed therein. Specifically, a first compartment 216 may define a first cube profile 244 while a second compartment 218 may define a second cube profile 246 that is different from the first cube profile 244. Thus, the second compartment 218 may form ice cubes that are differently-shaped (e.g., smaller in volume or mass) than the ice cubes that are formed by the first compartment 216.

In certain embodiments, a first compartment set (i.e., a plurality of first compartments 216) and a second compartment set (i.e., a plurality of second compartments 218) are provided. Optionally, the first and second compartment sets may be grouped separately such that all of the first compartments 216 are grouped together in the first compartment set while all of the second compartments 218 are grouped together in the second compartment set. Thus, the first and second compartment sets may be axially-spaced apart from each other. For instance, the first compartment set may be proximal to the first end portion 212 (i.e., distal to the second end portion 214) while the second compartment set is proximal to the second end portion 214 (i.e., distal to the first end portion 212).

In exemplary embodiments, the first cube profile 244 and the second cube profile 246 are defined as open cups about separate radii (e.g., as arcs such that the crescent-shaped ice cubes are formed therein). Thus, the first cube profile 244 may be defined about a first radius 248 while the second cube profile 246 is defined about a second radius 250. The second radius 250 may be smaller than the first radius 248. In turn, the ice cubes formed by the second compartment 218 may be smaller than those formed by the first compartment 216. Optionally, the second radius 250 may be less than or equal to half of the first radius 248. Advantageously, mold body 210 may form ice cubes are noticeably-different sizes and permit users to select between such sizes (e.g., depending on an intended use, desired mouth feel, etc.).

Although the centerpoint of each radii (i.e., point about which a corresponding radius 248 or 250 is defined) may be disposed along the rotation axis $A_R$, as shown, it is understood that alternative embodiments may establish or define a centerpoint that is radially-offset from the rotation axis $A_R$.

As shown, ejector 236 is rotatably disposed above both first cube profile 244 and second cube profile 246. First harvester 238 selectively extends within first compartment 216 (e.g., based on the rotation position of ejector 236) and second harvester 240 selectively extends within second compartment 218 (e.g., based on the rotation position of ejector 236) to motivate ice cubes from the first and second compartments 216, 218, respectively. In some embodiments, first harvester 238 and second harvester 240 may each define a tine length 252 or 254(e.g., as measured in millimeters radially outward from the rotation axis $A_R$). Optionally, the second tine length 254 of the second harvester 240 may be less than the first tine length 252 of the first harvester 238. If multiple first compartments 216 or second compartments 218 are provided, a corresponding number of first harvesters 238 or second harvesters 240 may similarly be provided.

Figure 7:
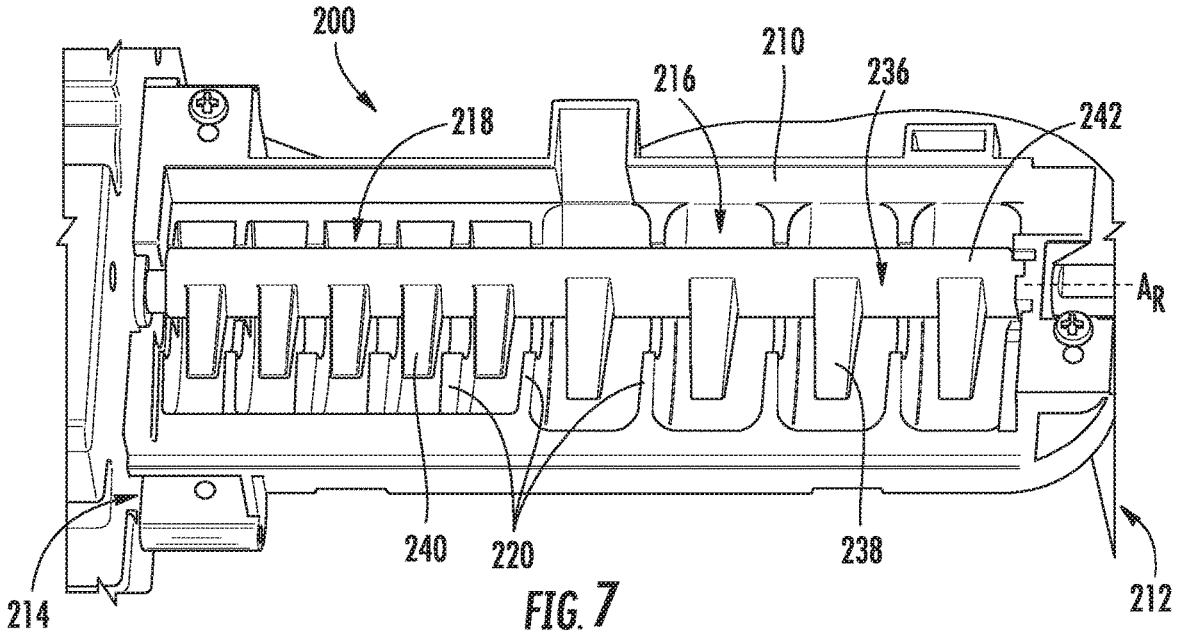
FIG. 7 provides a perspective view of the exemplary ice maker of FIG. 6, wherein certain components have been removed for clarity.
Figure 8:
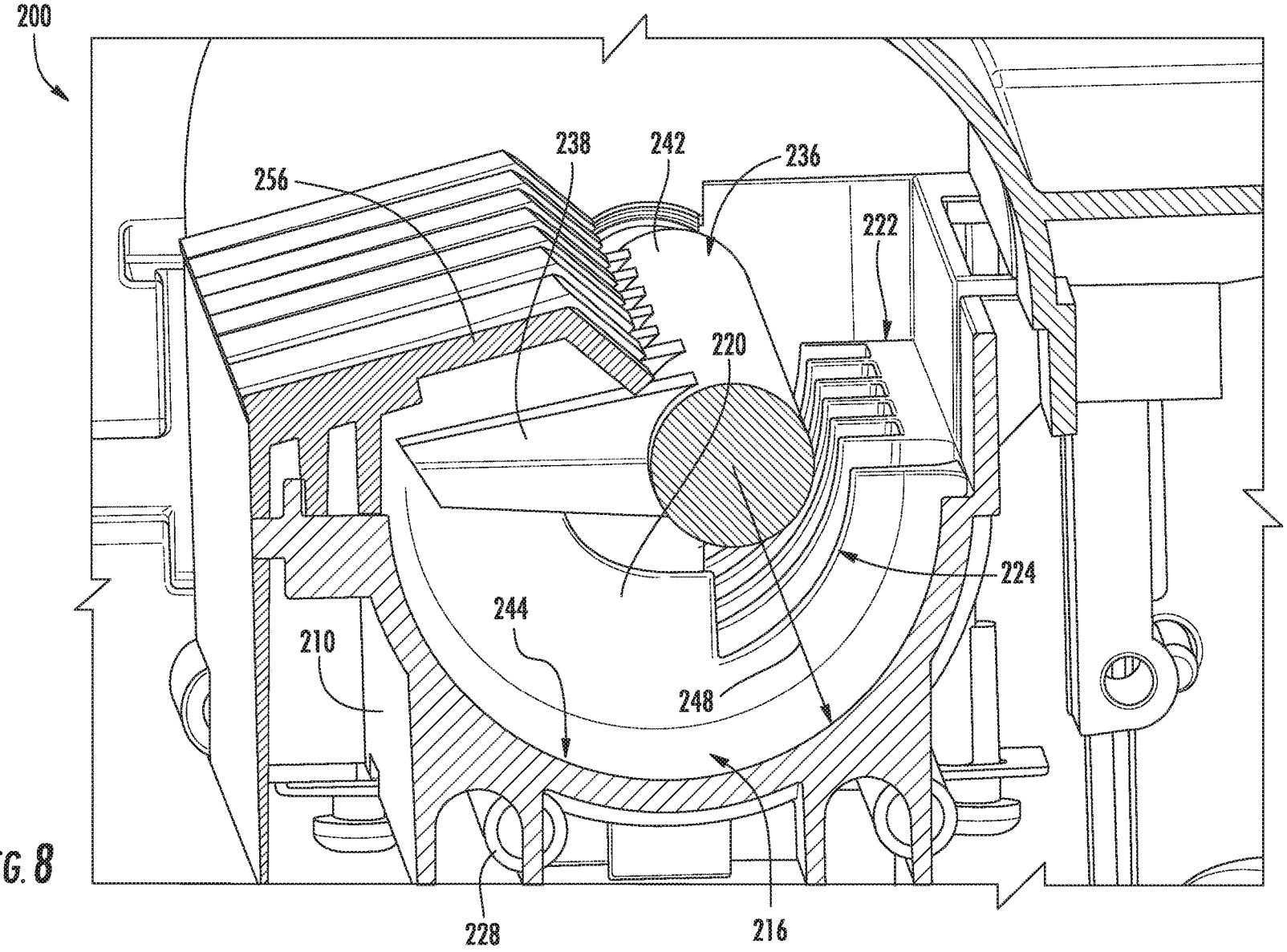
FIG. 8 provides a sectional view of the ice maker of the exemplary ice making assembly of FIG. 5.
Figure 9:
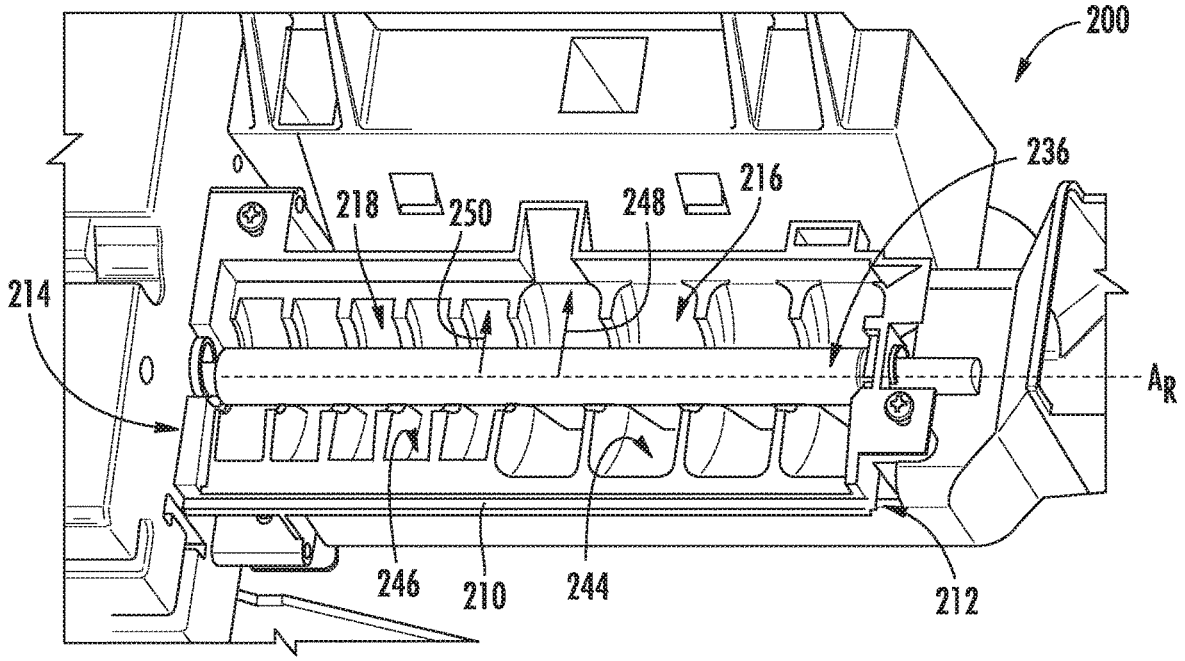
FIG. 9 provides a perspective view of the exemplary ice maker of FIG. 7, wherein an ejector has been rotated to an intermediate position.
Figure 10:
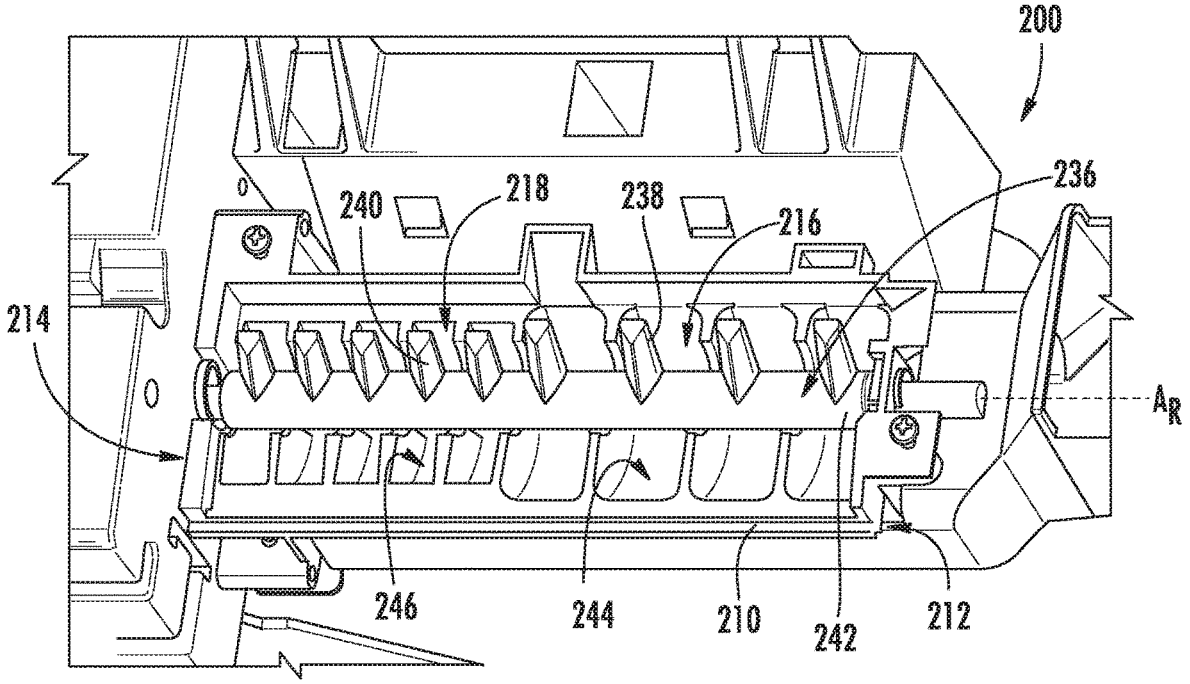
FIG. 10 provides a perspective view of the exemplary ice maker of FIG. 7, wherein an ejector has been rotated to an ejection position.

Turning now specifically to FIGS. 7, 9, and 10, rotation of ejector 236 is illustrated from a fill position (FIG. 7) to an ejection position (FIG. 10). At least one intermediate position (FIG. 9) between the fill position and the ejection position is also illustrated. In the fill position, harvesters 238 or 240 are generally positioned above (e.g., along the vertical direction V) mold body 210. Moreover, compartments 216, 218 of mold body 210 are ready for receiving liquid water for freezing. Thus, liquid water can be directed into compartments 216, 218 of mold body 210 in the fill position. With ice maker 200 positioned in a suitably cool location, water within compartment 216 or 218 will freeze and form ice cubes. A controller, such as controller 190 (FIG. 1) can monitor or measure a temperature of mold body 210 via a temperature sensor (not pictured) mounted to mold body 210. When the temperature of mold body 210 drops below the freezing point of water within mold body 210, it can be inferred that one or more ice cubes are fully frozen within mold body 210.

Figure 11:
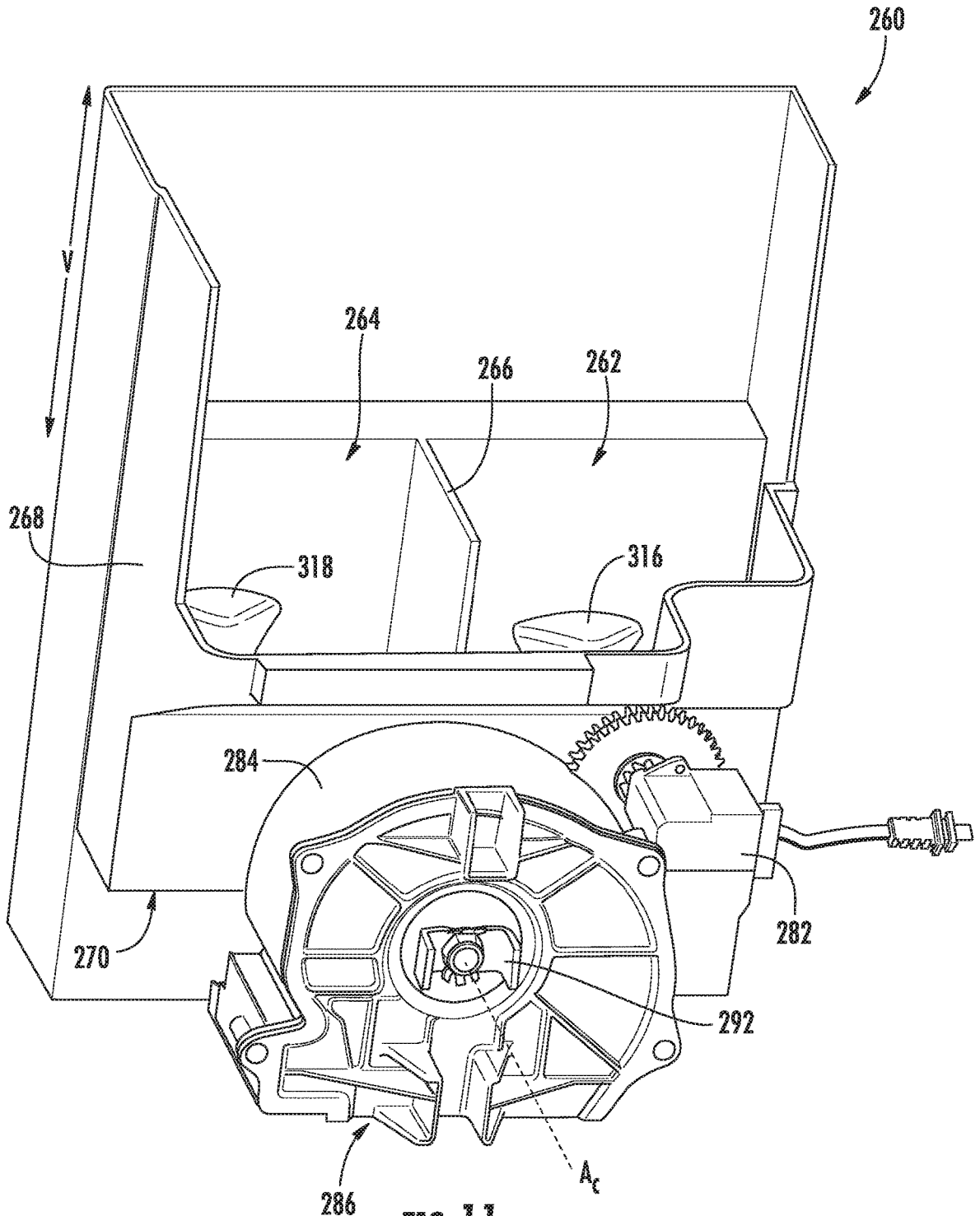
FIG. 11 provides a perspective view of an ice bucket of an ice making assembly according to exemplary embodiments of the present disclosure.
Figure 12:
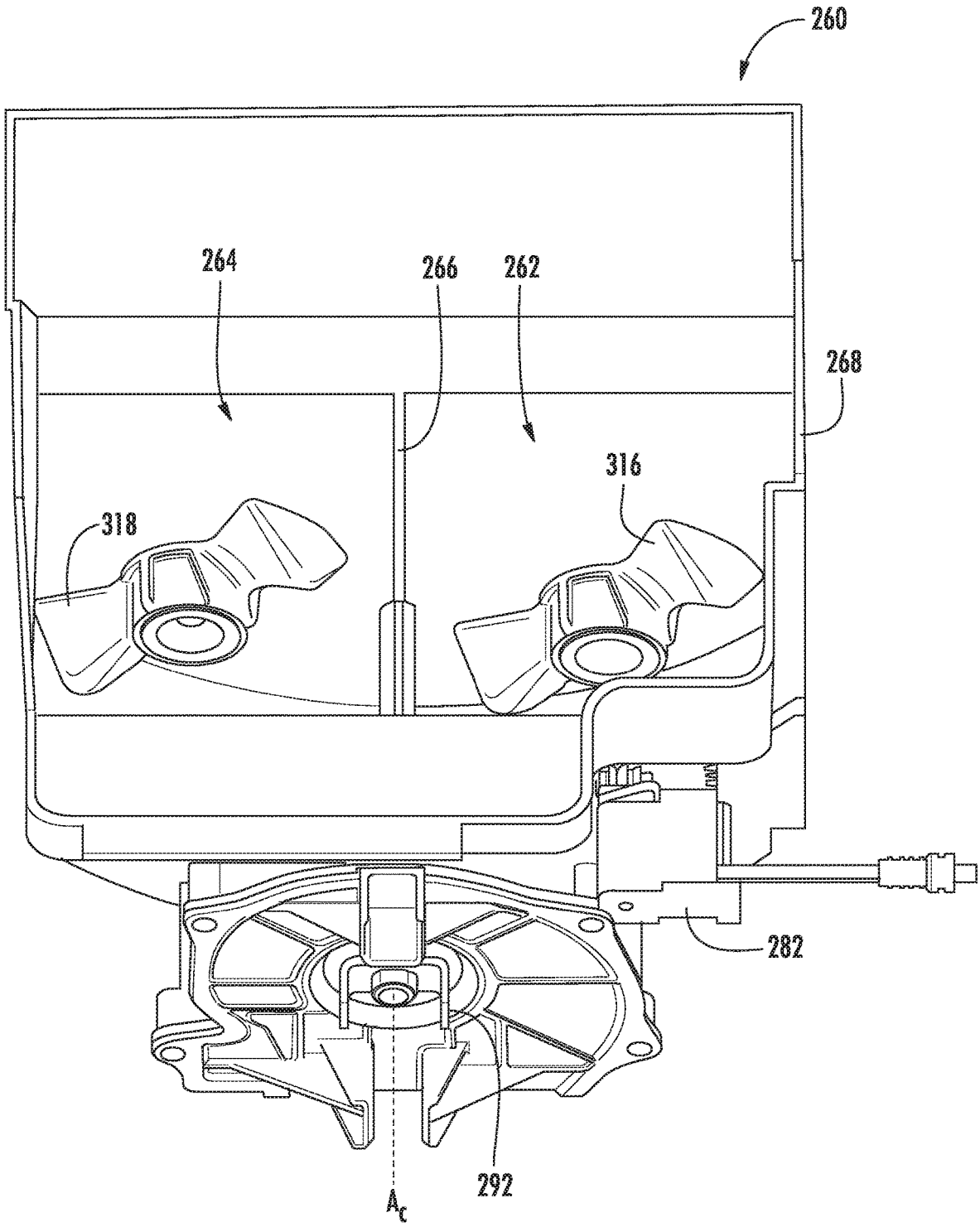
FIG. 12 provides a top perspective view of the exemplary ice bucket of FIG. 11.
Figure 13:
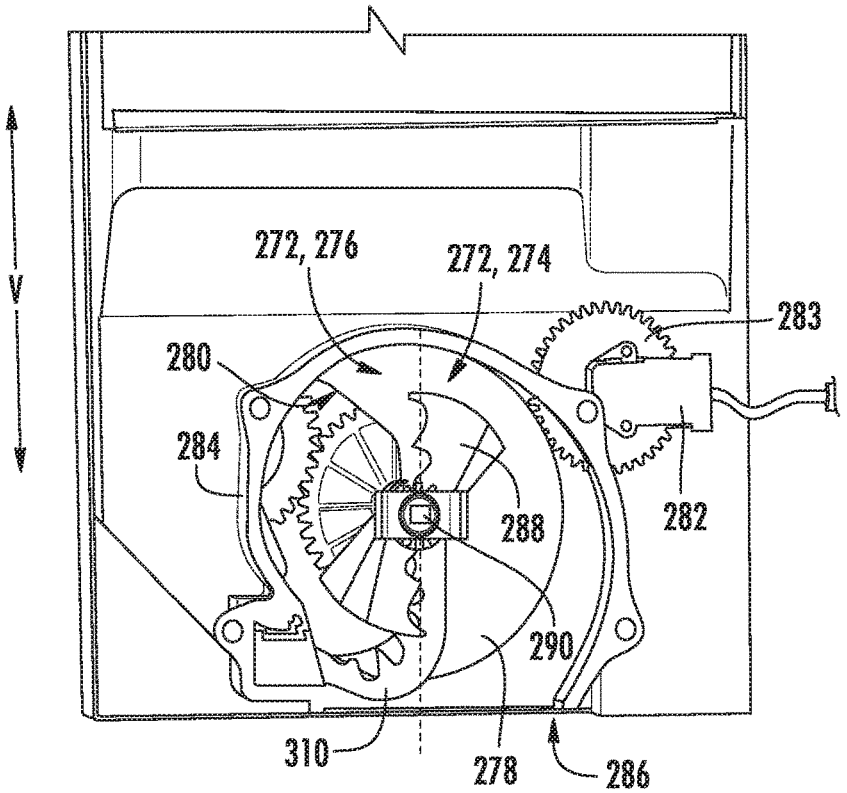
FIG. 13 provides a perspective view an inner bottom portion of the exemplary ice bucket of FIG. 11.
Figure 14:
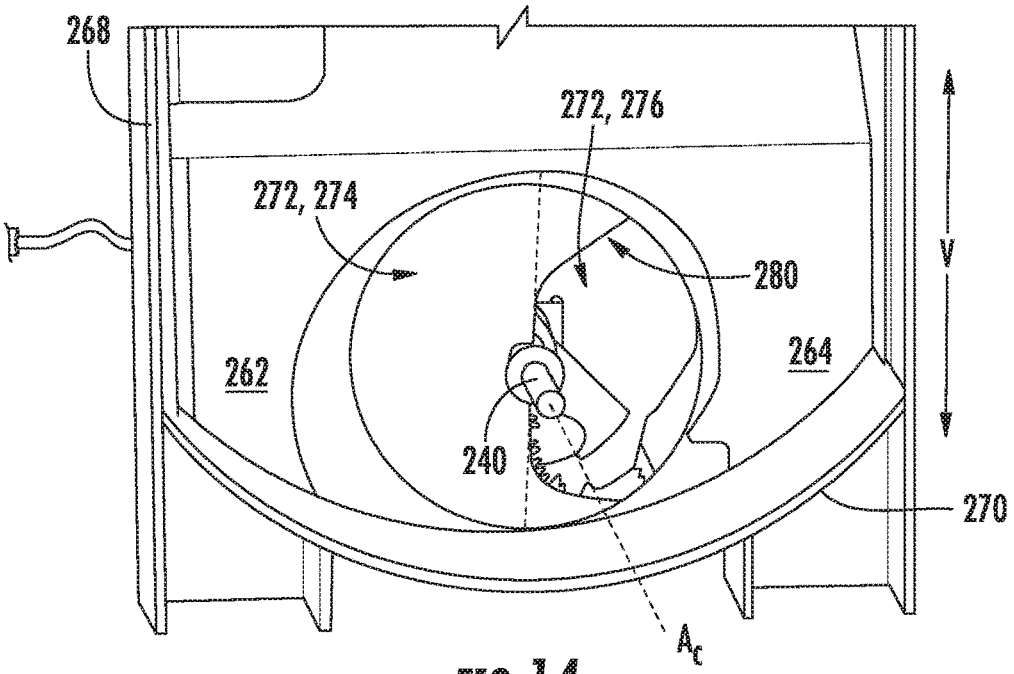
FIG. 14 provides a perspective view an outer bottom portion of the exemplary ice bucket of FIG. 11.
Figure 15:
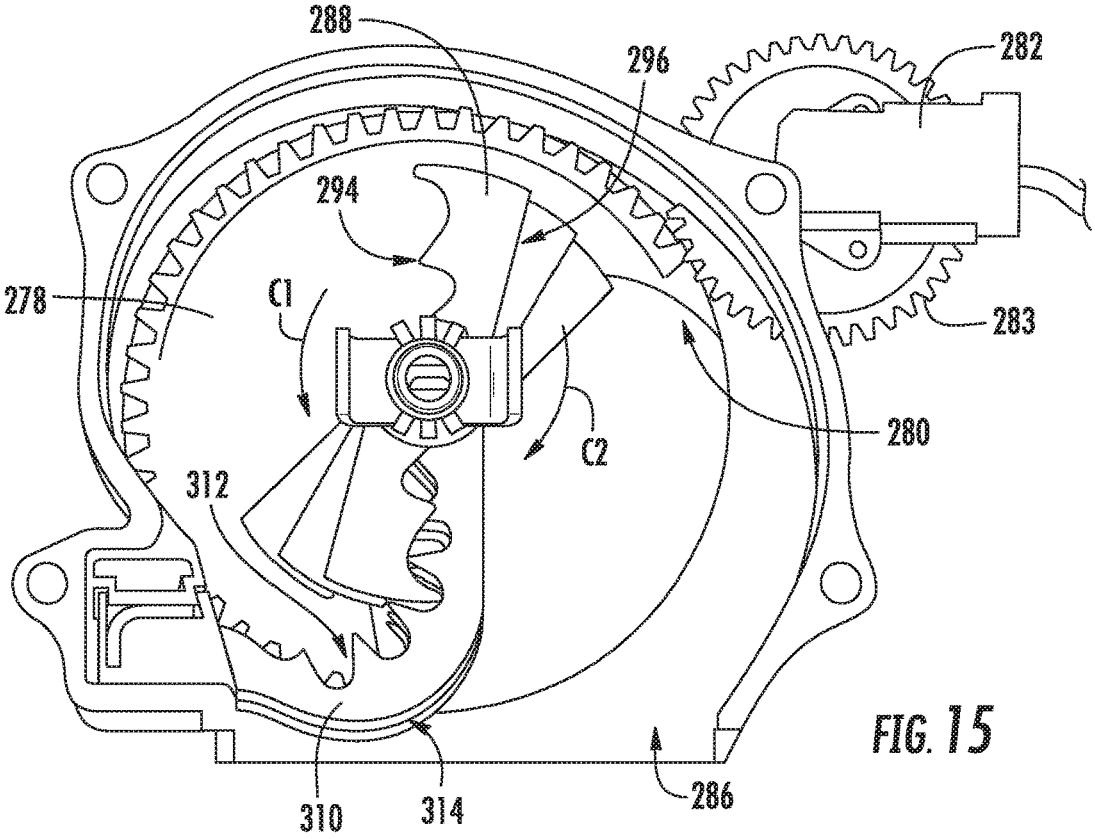
FIG. 15 provides a perspective view of a portion of the exemplary ice bucket of FIG. 11.
Figure 16:
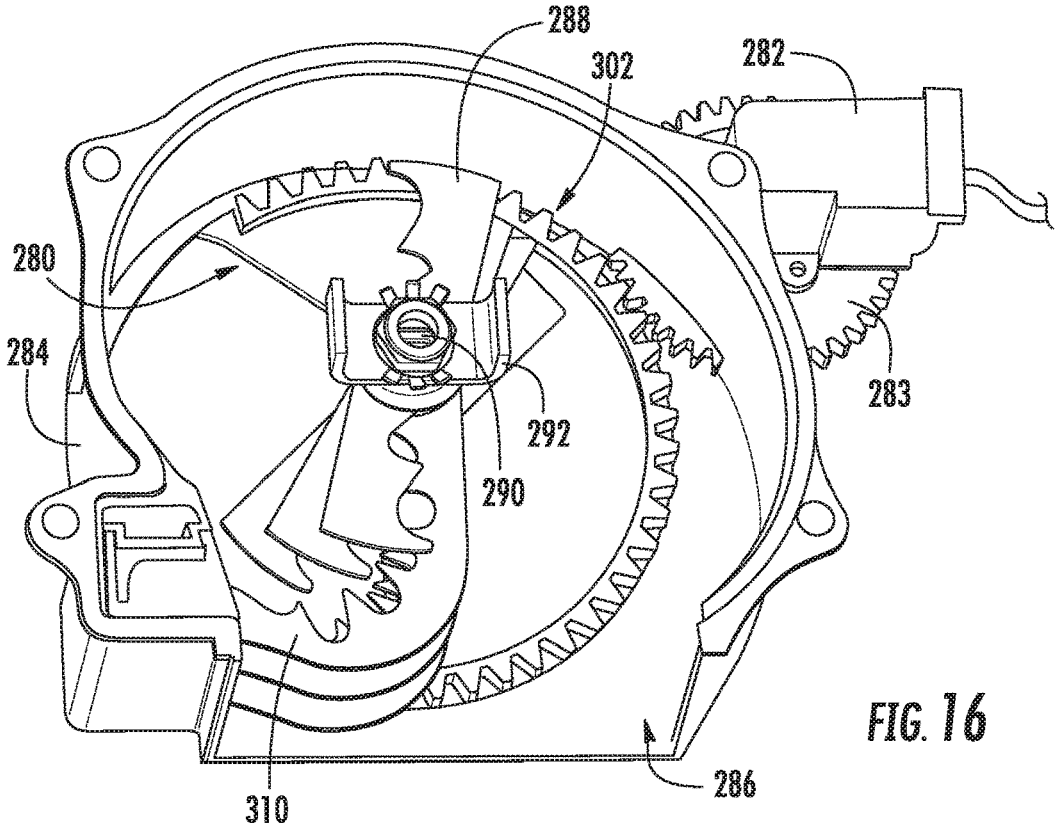
FIG. 16 provides a perspective view of a portion of the exemplary ice bucket of FIG. 11.

After an ice cube has frozen, harvesters 238 or 240 may eject ice from mold body 210. Rotation of ejector 236 brings harvesters 238 or 240 into engagement with a top portion of ice cubes. As ejector 236 continues to rotate about rotation axis $A_R$, ice cubes are motivated upward (e.g., along a corresponding ice cube profile 244 or 246). Eventually, a harvester 238 or 240 may be rotated beneath an ice cube. The harvester 238 or 240 may subsequently motivate or force an ice cube out of a corresponding compartment 216 or 218 and onto stripper tines 256 (FIG. 6) as harvesters 238 or 240 are rotated to the ejection position (FIG. 10). In the ejected position, harvesters 238 or 240 are moved to a discrete angular position (e.g., at least 180° from the fill position). In some embodiments, the ejected position may force harvesters 238 or 240 to be substantially upright or parallel to vertical direction V. From the ejected position, ice cubes may be motivated (e.g., by gravity) from stripper tine 256 or to another portion of refrigerator appliance 100 (e.g., ice bucket 260—FIG. 11).

Turning now to FIGS. 11 through 16, various portions of an exemplary ice bucket 260 are provided. As would be understood, ice bucket 260 may be provided as or as part of ice bin 164 (FIG. 2) disposed, at least partially below ice maker 200 (including mold body 210—FIG. 5).

When assembled, ice bucket may be removable from appliance 100 (e.g., within door 128—FIG. 2), such as to place ice bucket on a kitchen counter or sink. Nonetheless, during use (e.g., when mounted on appliance 100), multiple chambers (e.g., a first chamber 262 and a second chamber 264) defined by ice bucket 260 are disposed below mold body 210. For instance, first chamber 262 may be disposed below (e.g., in vertical alignment with) first compartment 216 or first compartment set to receive ice therefrom. Additionally or alternatively, second chamber 264 may be disposed below (e.g., in vertical alignment with) second compartment 218 or second compartment set to receive ice therefrom. In some embodiments, the relatively large ice cubes of first compartment 216 are advantageously received and stored within first chamber 262 while the relatively small ice cubes of second compartment 218 are separately received and stored within second chamber 264. Optionally, a divider wall 266 may be disposed within ice bucket 260 (e.g., within an internal volume defined by bucket sidewalls 268 and a bucket bottom wall 270) to separate (e.g., axially separate) first chamber 262 from second chamber 264.

As shown, ice bucket 260 defines an outlet opening 272 through which ice may be selectively permitted from ice bucket 260 (e.g., from first chamber 262 or second chamber 264). In some embodiments, outlet opening 272 is defined at a bottom end of ice bucket 260 (e.g., through bucket sidewall 268). Generally, outlet opening 272 can have a first portion 274 and a second portion 276. Specifically, first portion 274 may be in fluid communication with first chamber 262 while second portion 276 is in fluid communication with second chamber 264. For instance, first portion 274 may be disposed on one side of divider wall 266 (e.g., one internal or axial side), and second portion 276 may be disposed on another side of divider wall 266 (e.g., the opposite internal or axial side from the internal or axial side as first portion 274). In some such embodiments, first portion 274 and second portion 276 may generally be considered separate, fluid parallel, halves of outlet opening 272. Ice within first chamber 262 may thus pass through the first portion 274 of outlet opening 272 without passing through second portion 276. Similarly, ice within second chamber 264 may pass through the second portion 276 of outlet opening 272 without passing through first portion 274.

In some embodiments, a shutter 278 is disposed at the outlet opening 272. Specifically, shutter 278 is movably mounted to selectively restrict ice from first chamber 262 and second chamber 264 (e.g., to prevent ice from exiting the internal volume of ice bucket 260). The restriction of chambers 262, 264 may alternate such that when shutter 278 prevents ice from exiting first chamber 262, ice is permitted from second chamber 264, and vice versa. For instance, shutter 278 may be movable across outlet opening 272 between a first position (e.g., FIG. 15) and a second position (e.g., FIG. 16). In the first position, the shutter 278 covers second portion 276 and is spaced apart, at least partially, from second portion 276 (e.g., such that an aperture 280 of shutter 278 is aligned with first portion 274). In the second position, the shutter 278 covers first portion 274 and is spaced apart, at least partially, from first portion 274 (e.g., such that the aperture 280 of shutter 278 is aligned with second portion 276). Optionally, the aperture 280 may have a smaller cross-sectional area (e.g., perpendicular to a central axis $A_C$) than either (e.g., both of) first portion 274 or second portion 276, as shown.

In certain embodiments, shutter 278 defines a central axis $A_C$ about which shutter 278 may rotate (e.g., in a first circumferential direction C1 or a second circumferential direction C2). For instance, shutter 278 may be rotatably mounted on ice bucket 260 to rotate about central axis $A_C$ between the first position and the second position. In such some embodiments, a chamber-selection motor 282 is provided to motivate rotation of shutter 278 (e.g., as directed by a user selection at user interface 148—FIG. 1). For instance, chamber-selection motor 282 may be in mechanical communication with shutter 278 such that movement at chamber-selection motor 282 is transferred to shutter 278 (e.g., via one or more gears). In the illustrated embodiments, chamber-selection motor 282 may rotate shutter 278 in the first circumferential direction C1 to move from the first position to the second position. Chamber-selection motor 282 may further rotate shutter 278 in the second circumferential direction C2 to move from the second position to the first position. Thus, chamber-selection motor 282 may be a reversible motor to alternately rotate in the first and second circumferential directions C1, C2. Alternatively, though, chamber-selection motor 282 may be a non-reversible motor capable of rotating in only the first circumferential direction C1 or the second circumferential direction C2.

In some embodiments, chamber-selection motor 282 include a drive gear 283 (e.g., radially offset from central axis $A_C$) and shutter 278 includes a plurality of gear teeth 302. As shown, the plurality of gear teeth 302 may be disposed along a circumferential edge of shutter 278. When assembled, the drive gear 283 of chamber-selection motor 282 is in communication (e.g., directly or indirectly enmeshed) with the plurality of gear teeth 302. Movement of the drive gear 283 may thus be transmitted to shutter 278 to move shutter 278 between the first and second positions.

It is noted that although a single drive gear is illustrated, additional or alternative embodiments may include any suitable gearing or motion-transfer mechanism (e.g., rack-and-pinion gear, bevel gearing, etc.) for transmitting movement at the chamber-selection motor 282 to the shutter 278.

Optionally, a drum wall 284 may extend about outlet opening 272 (e.g., outside of the internal volume of ice bucket 260 or downstream from outlet opening 272). As shown, drum wall 284 may define a drop channel 286 (e.g., directed downward) through which ice may pass (e.g., to discharging outlet 144—FIG. 1). In some embodiments, shutter 278 is housed within drum wall 284 to rotate therein (e.g., outside of the internal volume of ice bucket 260). Ice passed from outlet opening 272 may thus be transmitted past shutter 278 and into a region defined by drum wall 284. Additionally or alternatively, drum wall 284 may extend about the central axis $A_C$ such that ice cubes are transmitted therealong before exiting through drop channel 286.

In certain embodiments, one or more rotatable blades 288 are provided adjacent to outlet opening 272. In particular, a rotatable blade 288 may be disposed downstream from shutter 278 or outlet opening 272 to engage (e.g., crush or move) ice cubes therefrom. In exemplary embodiments, rotatable blade 288 is fixed to a rotation pin 290 (e.g., extending along the central axis $A_C$) to rotate therewith. Optionally, rotatable blade 288 may be housed within the drum wall 284 to crush or motivate ice cubes therethrough. For instance, a dispenser/crusher motor (not pictured) may selectively connect to (e.g., in mechanical communication with) rotation pin 290, such as via key 292, to direct rotation of rotation pin 290 and, thus, rotatable blade 288.

As shown, the rotatable blade 288 may include a cutting edge 294 having, for example, a plurality of teeth. Specifically, the plurality of teeth of the cutting edge 294 may be formed on one circumferential edge (e.g., facing the first circumferential direction C1) of rotatable blade 288. In some such embodiments, a flat edge 296 (e.g., planar edge extending radially from the central axis $A_C$) is provided on the opposite circumferential edge (e.g., facing the first circumferential direction C2) of rotatable blade 288.

In additional or alternative embodiments, one or more non-rotatable or stationary blades 310 are disposed downstream from shutter 278 or outlet opening 272. For instance, a stationary blade 310 may be housed within the drum wall 284. When assembled, the stationary blade 310 may be rotationally fixed such that the stationary blade 310 is non-rotatable about the central axis $A_C$. As shown, stationary blade 310 may be rotatably attached to the rotation pin 290 (e.g., at one end) such that the rotation pin 290 can rotate relative to stationary blade 310. Additionally or alternatively, stationary blade 310 may be fixed (e.g., at another end) to drum wall 284). In some such embodiments, stationary blade 310 may thus remain in a fixed position as rotatable blades 288 move about central axis $A_C$. Optionally, stationary blade 310 may include a cutting edge 312 (e.g., facing the second circumferential direction C2) or a flat edge 314 (e.g., facing the first circumferential direction C1). Additionally or alternatively, stationary blade 310 may extend generally in front of the second portion 276 of outlet opening 272 (e.g., radially outward from rotation pin 290 in a common direction with second portion 276).

Advantageously, in some embodiments, the blades 288, 310 may act to crush the relatively small ice cubes from the second chamber 264 (e.g., against the plurality of teeth of the blades 288, 310), while the relatively large ice cubes from the first chamber 262 are primarily guided by the flat edge 314 of rotatable blade 288.

Separate from or in addition to the blades, one or more agitator paddles may be provided within the internal volume of ice bucket 260 to selectively agitate ice therein.

In some embodiments, a first agitator paddle 316 is rotatably disposed within the first chamber 262. For instance, first agitator paddle 316 may be mounted to a bucket sidewall 268 (e.g., to rotate about an axis parallel to the central axis $A_C$). Optionally, first agitator paddle 316 may be in communication with rotation pin 290 (e.g., via one or more intermediate gears) to selectively rotate as directed by the dispenser/crusher motor. During use, first agitator paddle 316 may thus be selectively rotated to aid movement or agitate (e.g., to prevent sublimation of) ice within first chamber 262.

In additional or alternative embodiments, a second agitator paddle 318 is rotatably disposed within the second chamber 264. For instance, second agitator paddle 318 may be mounted to a bucket sidewall 268 (e.g., to rotate about an axis parallel to the central axis $A_C$ or parallel to the first agitator paddle 316). Optionally, second agitator paddle 318 may be in communication with rotation pin 290 (e.g., via one or more intermediate gears) to selectively rotate as directed by the dispenser/crusher motor. During use, second agitator paddle 318 may thus be selectively rotated to aid movement or agitate (e.g., to prevent sublimation of) sublimation of ice within second chamber 264.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly comprising:

a body comprising an ice mold for receiving and freezing water, the ice mold defining a discrete first compartment and second compartment within which water freezes, the first compartment defining a first cube profile, the second compartment being axially-spaced apart from the first compartment and defining a second cube profile, the second cube profile being different from the first cube profile;

an ejector rotatably disposed above the first cube profile and the second cube profile to motivate ice from the first and second compartments; and an ice bucket disposed below the ice mold, the ice bucket defining a first chamber below the first ice compartment to receive ice therefrom, and a second chamber separated from the first chamber, the second chamber being below the second ice compartment to receive ice therefrom.

2. The ice making assembly of claim 1, wherein the first cube profile is defined about a first radius, and wherein the second cube profile is defined about a second radius, the second radius being smaller than the first radius.

3. The ice making assembly of claim 2, wherein the second radius is less than or equal to half of the first radius.

4. The ice making assembly of claim 1, wherein the ejector comprises a main shaft extending axially along an axis of rotation, a first harvester selectively extending within the first compartment from the main shaft, and a second harvester selectively extending within the second compartment from the main shaft to rotate in tandem with the first harvester.

5. The ice making assembly of claim 4, wherein the first harvester defines a first tine length, and wherein the second harvester defines a second tine length less than the first tine length.

6. The ice making assembly of claim 1, wherein the ice mold comprises a partition wall axially positioned between the first compartment and the second compartment, wherein the partition wall extends vertically to an upper fill line, and wherein the partition wall divides a notch gap extending below the fill line to permit the exchange of water between the first and second compartments above a predetermined height.

7. The ice making assembly of claim 1, further comprising a heater mounted to the ice mold beneath the first and second compartments, the heater being in thermal communication with the first and second compartments to selectively direct heat thereto.

8. The ice making assembly of claim 1, further comprising a motor in mechanical communication with the ejector to motivate rotation thereof, wherein the ice mold extends axially from a first end proximal to the first compartment to a second end proximal to the second compartment, and wherein the motor is mounted to the ice mold on the second end.

9. A refrigerator appliance comprising:

a cabinet defining a chilled chamber;

a door mounted to the cabinet; and an ice maker mounted to the door, the ice maker comprising a body comprising an ice mold for receiving and freezing water, the ice mold defining a discrete first compartment and second compartment within which water freezes, the first compartment defining a first cube profile, the second compartment being axially-spaced apart from the first compartment and defining a second cube profile, the second cube profile being different from the first cube profile, and an ejector rotatably disposed above the first cube profile and the second cube profile to motivate ice from the first and second compartments wherein the first cube profile is defined about a first radius, and wherein the second cube profile is defined about a second radius, the second radius being smaller than the first radius.

10. The refrigerator appliance of claim 9, wherein the second radius is less than or equal to half of the first radius.

11. The refrigerator appliance of claim 9, wherein the ejector comprises a main shaft extending axially along an axis of rotation, a first harvester selectively extending within the first compartment from the main shaft, and a second harvester selectively extending within the second compartment from the main shaft to rotate in tandem with the first harvester.

12. The refrigerator appliance of claim 11, wherein the first harvester defines a first tine length, and wherein the second harvester defines a second tine length less than the first tine length.

13. The refrigerator appliance of claim 9, wherein the ice mold comprises a partition wall axially positioned between the first compartment and the second compartment, wherein the partition wall extends vertically to an upper fill line, and wherein the partition wall divides a notch gap extending below the fill line to permit the exchange of water between the first and second compartments above a predetermined height.

14. The refrigerator appliance of claim 9, wherein the ice maker further comprises a heater mounted to the ice mold beneath the first and second compartments, the heater being in thermal communication with the first and second compartments to selectively direct heat thereto.

15. The refrigerator appliance of claim 9, wherein the ice maker further comprises a motor in mechanical communication with the ejector to motivate rotation thereof, wherein the ice mold extends axially from a first end proximal to the first compartment to a second end proximal to the second compartment, and wherein the motor is mounted to the ice mold on the second end.

16. The refrigerator appliance of claim 9, further comprising an ice bucket disposed within the door, the ice bucket defining a first chamber below the first ice compartment to receive ice therefrom, and a second chamber separated from the first chamber, the second chamber being below the second ice compartment to receive ice therefrom.

17. An ice making assembly comprising:

a body comprising an ice mold for receiving and freezing water, the ice mold defining a discrete first compartment and second compartment within which water freezes, the first compartment defining a first cube profile, the second compartment being axially-spaced apart from the first compartment and defining a second cube profile, the second cube profile being different from the first cube profile; and an ejector rotatably disposed above the first cube profile and the second cube profile to motivate ice from the first and second compartments;

wherein the first cube profile is defined about a first radius, and wherein the second cube profile is defined about a second radius, the second radius being smaller than the first radius.

18. The ice making assembly of claim 17, wherein the ejector comprises a main shaft extending axially along an axis of rotation, a first harvester selectively extending within the first compartment from the main shaft, and a second harvester selectively extending within the second compartment from the main shaft to rotate in tandem with the first harvester.

19. The ice making assembly of claim 17, wherein the ice mold comprises a partition wall axially positioned between the first compartment and the second compartment, wherein the partition wall extends vertically to an upper fill line, and wherein the partition wall divides a notch gap extending below the fill line to permit the exchange of water between the first and second compartments above a predetermined height.

20. The ice making assembly of claim 17, further comprising a motor in mechanical communication with the ejector to motivate rotation thereof, wherein the ice mold extends axially from a first end proximal to the first compartment to a second end proximal to the second compartment, and wherein the motor is mounted to the ice mold on the second end.

* * * * *